US008069825B1

(12) United States Patent
Higgins

(10) Patent No.: US 8,069,825 B1
(45) Date of Patent: Dec. 6, 2011

(54) CIRCULATING FLUIDIZED BED BOILER HAVING IMPROVED REACTANT UTILIZATION

(75) Inventor: Brian S. Higgins, Walnut Creek, CA (US)

(73) Assignee: Nalco Mobotec, Inc., Naperville, IL (US)

( * ) Notice: Subject to any disclaimer, the term of this patent is extended or adjusted under 35 U.S.C. 154(b) by 837 days.

(21) Appl. No.: 12/142,524

(22) Filed: Jun. 19, 2008

Related U.S. Application Data

(63) Continuation of application No. 11/281,915, filed on Nov. 17, 2005, now Pat. No. 7,410,356.

(51) Int. Cl.
*F27B 15/10* (2006.01)

(52) U.S. Cl. ..... 122/4 D; 432/17; 165/104.16

(58) Field of Classification Search ..... 432/15, 432/17, 58; 122/4 D; 165/104.16
See application file for complete search history.

(56) References Cited

U.S. PATENT DOCUMENTS

| | | | | |
|---|---|---|---|---|
| 3,105,540 | A | 10/1963 | Hardgrove | 431/9 |
| 3,528,797 | A | 9/1970 | Funk et al. | 71/39 |
| 3,565,757 | A | 2/1971 | Warshaw et al. | 23/2 |
| 3,773,897 | A | 11/1973 | Fields et al. | 423/235 |
| 3,847,564 | A | 11/1974 | Marion et al. | 48/95 |
| 3,860,384 | A | 1/1975 | Vulliet et al. | 41/4 |
| 3,900,554 | A | 8/1975 | Lyon | 423/235 |
| 3,970,739 | A | 7/1976 | Shiraishi et al. | 423/23 S |
| 4,021,188 | A | 5/1977 | Yamagishi et al. | 431/158 |
| 4,029,752 | A | 6/1977 | Cahn | 423/563 |
| 4,039,446 | A | 8/1977 | Ban et al. | 210/688 |
| 4,080,423 | A | 3/1978 | Smith et al. | 423/210 |
| 4,089,639 | A | 5/1978 | Reed et al. | 431/211 |
| 4,119,702 | A | 10/1978 | Anuhata et al. | 423/235 |
| 4,150,631 | A | 4/1979 | Frey et al. | 110/186 |
| 4,154,581 | A * | 5/1979 | Nack et al. | 48/197 R |
| 4,173,454 | A | 11/1979 | Heins | 44/522 |
| 4,196,057 | A | 4/1980 | May et al. | 205/775.5 |
| 4,208,386 | A | 6/1980 | Arand et al. | 423/235 |
| 4,213,944 | A | 7/1980 | Azuhata et al. | 423/235 |
| 4,294,178 | A | 10/1981 | Borio et al. | 110/347 |
| 4,325,924 | A | 4/1982 | Arand et al. | 423/235 |
| 4,375,949 | A | 3/1983 | Salooja | 431/7 |
| 4,381,718 | A | 5/1983 | Carver et al. | 110/347 |
| 4,469,050 | A * | 9/1984 | Korenberg | 122/4 D |
| 4,502,633 | A | 3/1985 | Saxon | 239/422 |

(Continued)

FOREIGN PATENT DOCUMENTS

DE 28 37 156 3/1979

(Continued)

OTHER PUBLICATIONS

Energy efficiency—our specialty—by Mobotec; undated related technology.

(Continued)

*Primary Examiner* — Gregory A Wilson
(74) *Attorney, Agent, or Firm* — MacCord Mason PLLC

(57) ABSTRACT

A method of operating a furnace having a circulating fluidized bed is described. Fuel is combusted in the fluidized bed. The fluidized bed includes a dense bed portion and a lower furnace portion adjacent to the dense bed portion. Reactant is injected in the furnace to reduce the emission of at least one combustion product in the flue gas. Secondary air is injected into the furnace above the dense bed. Using this method, the amount of reactant needed to reduce the emission of the at least one combustion product is reduced.

36 Claims, 6 Drawing Sheets

U.S. PATENT DOCUMENTS

| | | | | |
|---|---|---|---|---|
| 4,504,211 | A | 3/1985 | Beardmore | 44/604 |
| 4,506,608 | A | 3/1985 | Strohmeyer, Jr. | 110/245 |
| 4,507,075 | A | 3/1985 | Buss et al. | 431/115 |
| 4,507,269 | A | 3/1985 | Dean et al. | 423/235 |
| 4,565,137 | A | 1/1986 | Wright | 110/264 |
| 4,584,948 | A | 4/1986 | Syred et al. | 110/264 |
| 4,624,840 | A | 11/1986 | Dean et al. | 423/235 |
| 4,627,965 | A | 12/1986 | Hegemann et al. | 423/242 |
| 4,672,900 | A | 6/1987 | Santalla et al. | 431/9 |
| 4,704,084 | A | 11/1987 | Liu et al. | 431/7 |
| 4,751,065 | A | 6/1988 | Bowers | 423/235 |
| 4,766,851 | A | 8/1988 | Emsperger et al. | 122/4 D |
| 4,777,024 | A | 10/1988 | Epperly et al. | 423/235 |
| 4,780,289 | A | 10/1988 | Epperly et al. | 423/235 |
| 4,824,441 | A | 4/1989 | Kindig | 44/604 |
| 4,842,834 | A | 6/1989 | Burton | 423/235 |
| 4,873,930 | A | 10/1989 | Egnese et al. | 110/345 |
| 4,915,036 | A | 4/1990 | DeVita | 110/215 |
| 4,927,612 | A | 5/1990 | Bowers | 423/235 |
| 4,962,711 | A * | 10/1990 | Yamauchi et al. | 110/347 |
| 4,978,514 | A | 12/1990 | Hofmann et al. | 423/235 |
| 4,985,218 | A | 1/1991 | DeVita | 423/235 |
| 4,992,249 | A | 2/1991 | Bowers | 423/235 |
| 5,017,347 | A | 5/1991 | Epperly et al. | 423/235 |
| 5,032,154 | A | 7/1991 | Wright | 422/109 |
| 5,048,432 | A | 9/1991 | Hogmann | 110/345 |
| 5,052,921 | A | 10/1991 | Hemsath | 423/121 |
| 5,057,293 | A | 10/1991 | Epperly et al. | 423/235 |
| 5,105,747 | A | 4/1992 | Khinkis et al. | 110/345 |
| 5,139,754 | A | 8/1992 | Luftglass et al. | 423/235 |
| 5,146,858 | A | 9/1992 | Tokuda et al. | 110/261 |
| 5,240,404 | A | 8/1993 | Hemsath et al. | 431/9 |
| 5,261,602 | A | 11/1993 | Brent et al. | 239/132.3 |
| 5,286,467 | A | 2/1994 | Sun et al. | 423/239.1 |
| 5,310,334 | A | 5/1994 | Spiros | 431/5 |
| 5,336,081 | A | 8/1994 | Saito et al. | 431/190 |
| 5,342,592 | A | 8/1994 | Peter-Hoblyn et al. | 423/235 |
| 5,345,883 | A * | 9/1994 | Panos | 110/345 |
| 5,453,258 | A | 9/1995 | Lippmann et al. | 423/235 |
| 5,489,419 | A | 2/1996 | Diep et al. | 423/235 |
| 5,536,482 | A | 7/1996 | Diep et al. | 423/235 |
| 5,585,081 | A | 12/1996 | Chu et al. | 423/239.1 |
| 5,587,283 | A | 12/1996 | Karinthi et al. | 431/10 |
| 5,690,039 | A | 11/1997 | Monro et al. | 110/264 |
| 5,707,596 | A | 1/1998 | Lewandowski et al. | 423/235 |
| 5,728,357 | A | 3/1998 | von Harpe | 423/239.1 |
| 5,809,910 | A | 9/1998 | Svendssen | 110/235 |
| 5,853,684 | A | 12/1998 | Fang et al. | 423/239.1 |
| 5,854,173 | A | 12/1998 | Chang et al. | 502/417 |
| 6,019,068 | A * | 2/2000 | Tsuo et al. | 122/4 D |
| 6,042,371 | A | 3/2000 | Mitani et al. | 431/215 |
| 6,048,510 | A | 4/2000 | Zauderer | 423/235 |
| 6,109,911 | A | 8/2000 | Tamminen et al. | 431/4 |
| 6,190,628 | B1 | 2/2001 | Carter | 422/168 |
| 6,213,032 | B1 | 4/2001 | Breen et al. | 110/345 |
| 6,230,664 | B1 * | 5/2001 | Janka et al. | 122/4 D |
| 6,280,695 | B1 | 8/2001 | Lissiamski et al. | 423/239.1 |
| 6,315,551 | B1 | 11/2001 | Salzsieder et al. | 431/183 |
| 6,357,367 | B1 | 3/2002 | Breen et al. | 110/345 |
| 6,398,039 | B1 | 6/2002 | Xue et al. | 210/504 |
| 6,485,289 | B1 | 11/2002 | Kelly et al. | 431/4 |
| 6,527,828 | B2 | 3/2003 | Flippo et al. | 95/54 |
| 6,532,905 | B2 * | 3/2003 | Belin et al. | 122/4 D |
| 6,818,043 | B1 | 11/2004 | Chang et al. | 95/37 |
| 6,953,494 | B2 | 10/2005 | Nelson, Jr. | 95/134 |
| 7,198,769 | B2 | 4/2007 | Cichanowicz | 423/239.1 |
| 7,335,014 | B2 | 2/2008 | Higgins | 431/4 |
| 2003/0110948 | A1 | 6/2003 | Gaita et al. | 96/108 |
| 2003/0145580 | A1 | 8/2003 | Ripper et al. | 60/286 |
| 2004/0045437 | A1 | 3/2004 | Chang et al. | 95/134 |
| 2004/0120872 | A1 | 6/2004 | Fan et al. | 423/239.1 |
| 2004/0185399 | A1 | 9/2004 | Moberg | 431/4 |
| 2004/0185401 | A1 | 9/2004 | Moberg | 431/9 |
| 2004/0185402 | A1 | 9/2004 | Moberg | 431/9 |
| 2004/0253161 | A1 | 12/2004 | Higgins | 423/235 |
| 2005/0000901 | A1 | 1/2005 | Campbell et al. | 210/660 |
| 2005/0002841 | A1 | 1/2005 | Moberg | 423/235 |
| 2005/0013755 | A1 | 1/2005 | Higgins | 423/235 |

FOREIGN PATENT DOCUMENTS

| | | |
|---|---|---|
| EP | 0 326 943 | 1/1989 |
| EP | 0 787 682 A1 | 12/1996 |
| EP | 0 287 224 | 10/1998 |
| EP | 0936405 | 8/1999 |
| GB | GN 2 001 419 | 7/1978 |
| JP | 53-112273 | 9/1978 |
| JP | 2003 31322 | 1/2003 |
| WO | WO/87/03507 | 6/1987 |
| WO | WO/2005/079305 | 9/2005 |

OTHER PUBLICATIONS

Combined DeNox/DeSox and additional NOx Reduction by Cleaning Flue Gas Condensate from Ammonia, Moberg, et al, presentation at PowerGen Intl. Nov. 30-Dec. 2, 1999.

RJM-LT, "Does This New NOx Control Technology Obsolete SCRs?"; RMJ Corp., undated related technology.

* cited by examiner (Background Technology)

CIRCULATING FLUIDIZED BED BOILER HAVING IMPROVED REACTANT UTILIZATION

RELATED APPLICATIONS

This application is a continuation of U.S. patent application Ser. No. 11/281,915 filed Nov. 17, 2005, now U.S. Pat. No. 7,410,356, issued Aug. 12, 2008.

BACKGROUND

1. Field of the Invention

The present invention relates generally to circulating fluidized bed boilers and, more particularly to systems and methods of operating circulating fluidized bed boilers to improved reactant utilization.

2. Description of the Related Art

The combustion of sulfur-containing carbonaceous compounds, especially coal, results in a combustion product gas containing unacceptably high levels of sulfur dioxide. Sulfur dioxide is a colorless gas, which is moderately soluble in water and aqueous liquids. It is formed primarily during the combustion of sulfur-containing fuel or waste. Once released to the atmosphere, sulfur dioxide reacts slowly to form sulfuric acid ($H_2SO_4$), inorganic sulfate compounds, and organic sulfate compounds. Atmospheric $SO_2$ or $H_2SO_4$ results in undesirable "acid rain."

According to the U.S. Environmental Protection Agency, acid rain causes acidification of lakes and streams and contributes to damage of trees at high elevations and many sensitive forest soils. In addition, acid rain accelerates the decay of building materials and paints, including irreplaceable buildings, statues, and sculptures. Prior to falling to the earth, $SO_2$ and NOx gases and their particulate matter derivatives, sulfates and nitrates, also contribute to visibility degradation and harm public health.

Air pollution control systems for sulfur dioxide removal generally rely on neutralization of the absorbed sulfur dioxide to an inorganic salt by alkali to prevent the sulfur from being emitted into the environment. The alkali for the reaction most frequently used include either calcitic or dolomitic limestone, slurry or dry quick and hydrated lime, and commercial and byproducts from Theodoric lime and trona magnesium hydroxide. The $SO_2$, once absorbed by limestone, is captured in the existing particle capture equipment such as an electrostatic precipitator or baghouse.

Circulating fluidized bed boilers (CFB) utilize a fluidized bed of coal ash and limestone or similar alkali to reduce $SO_2$ emissions. The bed may include other added particulate such as sand or refractory. Circulating fluidized bed boilers are effective at reducing $SO_2$ and NOx emissions. A 92% reduction in $SO_2$ emissions is typical, but can be as high as 98%. The molar ratio of Ca/S needed to achieve this reduction is designed to be approximately 2.2, which is 2.2 times the stoichiometric ratio of the reaction of calcium with sulfur. However, due to inefficient mixing, the Ca/S molar ratio often increases to 3.0 or more to achieve desired levels of $SO_2$ capture. The higher ratio of Ca/S requires more limestone to be utilized in the process, thereby increasing operating costs. Additionally, inefficient mixing results in the formation of combustion "hotspots" that promote the formation of NOx.

Thus, there exists a need for circulating fluidized bed boiler having improved reactant utilization for reduction of undesirable combustion products, which at the same time may also reduce NOx formation.

SUMMARY

The present inventions are directed to systems and methods of operating a circulating fluidized bed boiler. In one embodiment, the circulating fluidized bed boiler includes a circulating fluidized bed having a dense bed portion and a lower furnace portion. The dense bed portion of the circulating fluidized bed boiler is typically maintained below the stoichiometric ratio (fuel rich stage) and the lower furnace portion is typically maintained above the stoichiometric ratio (fuel lean stage), thereby reducing the formation of NOx. The circulating fluidized bed boiler may also include a reactant to reduce the emission of at least one combustion product in the flue gas. A plurality of secondary air injection devices are positioned downstream of the dense bed for providing mixing of the reactant and the flue gas in the furnace above the dense bed. Using the present inventions, the amount of reactant required for the reduction of the emission of the combustion product is reduced.

In a preferred embodiment, the reactant may include caustic, lime, limestone, fly ash, magnesium oxide, soda ash, sodium bicarbonate, sodium carbonate, double alkali, sodium alkali, and the calcite mineral group which includes calcite ($CaCO_3$), gaspeite ($\{Ni, Mg, Fe\}CO_3$), magnesite ($MgCO_3$), otavite ($CdCO_3$), rhodochrosite ($MnCO_3$), siderite ($FeCO_3$), smithsonite ($ZnCO_3$), sphaerocobaltite ($CoCO_3$), and mixtures thereof. Typically, the reactant is limestone.

In typical embodiments, the secondary air injection ports or devices are located in the lower furnace portion of the circulating fluidized bed boiler above the dense bed. Injection devices may have a variety of configurations. The secondary air injection devices may be asymmetrically positioned with respect to one another. The secondary air injection devices may be opposed inline or opposed staggered, or combinations thereof. In one embodiment, the secondary air injection devices are positioned between about 10 feet and 30 feet above the dense bed. The secondary air injection devices may be positioned at a height in the furnace above the dense bed, wherein the ratio of the exit column density to the density of the dense bed top is greater than about 0.6. Typically, the secondary air injection devices are positioned at a height in the furnace wherein the gas and particle density is less than about 165% of the exit gas column density.

In many embodiments, the jet penetration of each secondary air injection port or device, when unopposed, is greater than about 50% of the furnace width. The jet stagnation pressure may be greater than about 15 inches of water above the furnace pressure, for example, about 30, about 40, about 50, about 60, or about 70 inches of water above the furnace pressure. In a typical embodiment, the jet stagnation pressure may be between about 15 inches and 40 inches of water above the furnace pressure. Preferably, the secondary air injection devices deliver between about 10% and 35% of the total air flow to the boiler.

Some embodiments may also include a return system including a separator for removing the carry over particles from the flue gas. The separator may be a cyclone separator. In an embodiment, the return system may also include a fines collector downstream from the separator. The fines collector may be a bag house or an electrostatic precipitator.

In another embodiment, the circulating fluidized bed boiler includes: (a) a circulating fluidized bed including: a dense bed portion; a lower furnace portion adjacent to the dense bed portion; and an upper furnace portion; (b) a reactant to reduce the emission of at least one combustion product in the flue gas; and (c) a plurality of secondary air injection devices downstream of the circulating fluidized bed for providing mixing of the reactant and the flue gas in the furnace above the dense bed, wherein the amount of reactant required for the reduction of the emission of the combustion product is reduced.

In another embodiment, the circulating fluidized bed boiler includes: (a) a circulating fluidized bed including a dense bed portion, a lower furnace portion adjacent to the dense bed portion, and an upper furnace portion, wherein the dense bed portion of the circulating fluidized bed boiler is maintained below the stoichiometric ratio (fuel rich stage) and the lower furnace portion is maintained above the stoichiometric ratio (fuel lean stage), thereby reducing the formation of NOx; (b) a reactant to reduce the emission of at least one combustion product in the flue gas; and (c) a plurality of secondary air injection devices downstream of the circulating fluidized bed for providing mixing of the reactant and the flue gas in the furnace above the dense bed, wherein the amount of reactant required for the reduction of the emission of the combustion product is reduced.

In another embodiment of the invention, the circulating fluidized bed boiler includes: (a) a circulating fluidized bed including: a dense bed portion; a lower furnace portion adjacent to the dense bed portion; and an upper furnace portion, wherein the dense bed portion of the circulating fluidized bed boiler is maintained below the stoichiometric ratio (fuel rich stage) and the lower furnace portion is maintained above the stoichiometric ratio (fuel lean stage), thereby reducing the formation of NOx; (b) a reactant to reduce the emission of at least one combustion product in the flue gas; (c) a plurality of secondary air injection devices downstream of the circulating fluidized bed for providing mixing of the reactant and the flue gas in the furnace above the dense bed, wherein the amount of reactant required for the reduction of the emission of the combustion product is reduced; and (d) a return system for returning carry over particles from the flue gas to the circulating fluidized bed.

The present inventions also include methods of operating the systems described above. For example, in many embodiments, the method includes combusting fuel in a fluidized bed having a dense bed portion and a lower furnace portion above the dense bed portion. A reactant is injected into the furnace to reduce the emission of at least one combustion product in the flue gas. Secondary air is injected into the furnace above the dense bed at a height in the furnace where gas and particle density is less than about 165% of the furnace exit gas and particle density.

These and other aspects of the present invention will become apparent to those skilled in the art after a reading of the following description of the preferred embodiment when considered with the drawings.

DESCRIPTION OF THE PREFERRED EMBODIMENTS

Figure 1:
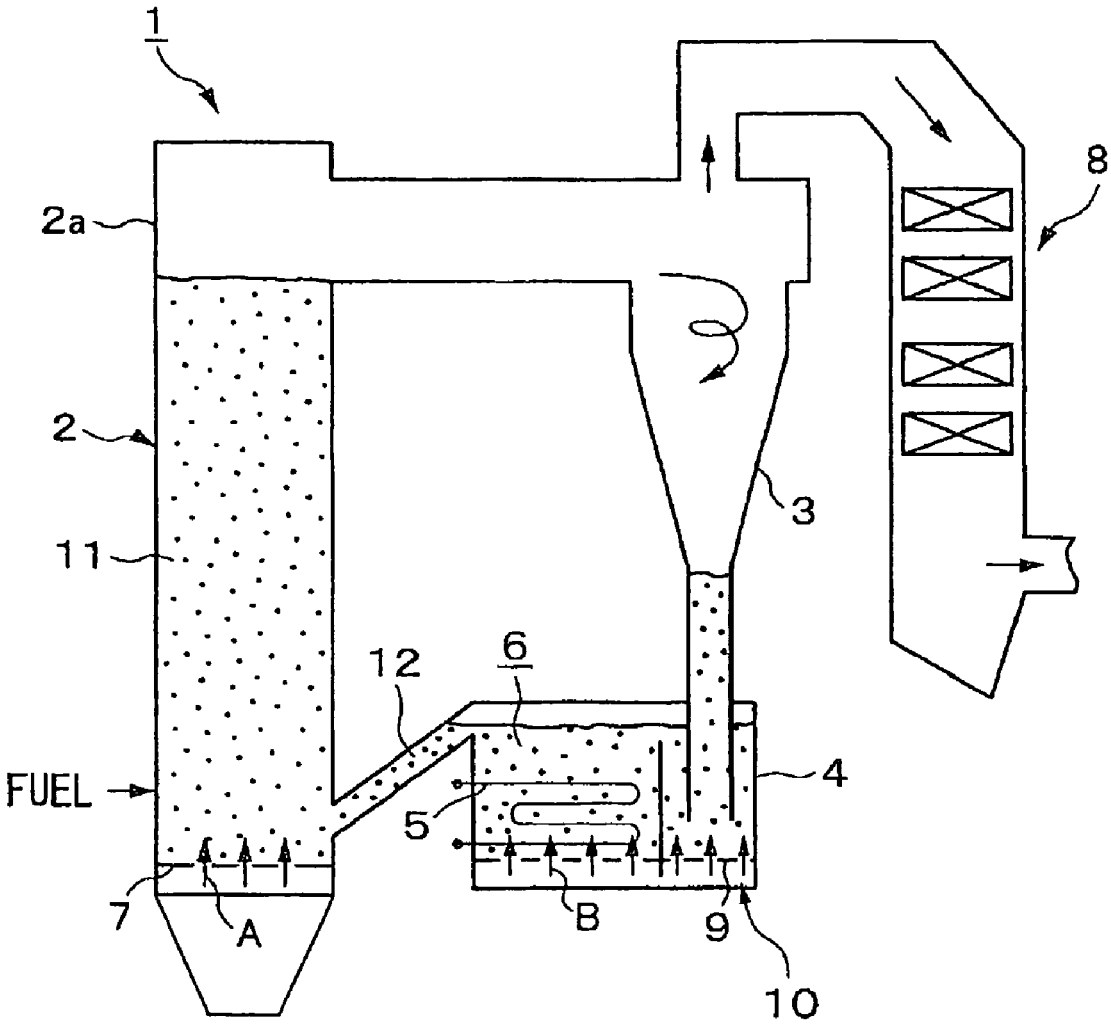
FIG. 1 is an illustration of a conventional circulating fluidized bed boiler (CFB)

In the description of the inventions, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms. In the present invention, "reducible acid" refers to acids in which the acidity can be reduced or eliminated by the electrochemical reduction of the acid. In this description of the embodiment, the term "port" is used to describe a reagent injection passageway without any constriction on the end. The term "injector" is used to describe a reagent injection passageway with a constrictive orifice on the end. The orifice can be a hole or a nozzle. An injection device or injection port is a device that includes any of ducts, ports, injectors, or a combination thereof. Most typically, injection ports or devices include at least an injector.

Referring now to the drawings in general, the illustrations are for the purpose of describing a preferred embodiment of the invention and are not intended to limit the invention thereto. FIG. 1 shows a conventional circulating fluidized bed boiler, generally designated 1. The circulating fluidized bed boiler may include a furnace 2, a cyclone dust collector 3, a seal box 4, and an optional external heat exchanger 6. Flue gas, which is generated by the combustion in the furnace 2 flows into the cyclone dust collector 3. The cyclone dust collector 3 also separates particles from the flue gas. Particles which are caught by the cyclone dust collector 3 flow into the seal box 4. An external heat exchanger 6 performs heat exchange between the circulating particles and in-bed tubes in the heat exchanger 6.

Typically, the furnace 2 consists of a water cooled furnace wall 2*a* and air distribution nozzles 7. The air distribution nozzles 7 introduce fluidizing air A to the furnace 2 to create a fluidizing condition in the furnace 2, and are arranged in a bottom part of the furnace 2. The cyclone dust collector 3 is connected with an upper part of the furnace 2. An upper part of the cyclone dust collector 3 is connected with the heat recovery area 8 into which flue gas which is generated by the combustion in the furnace 2 flows, and a bottom part of the cyclone dust collector 3 is connected with the seal box 4 into which the caught particles flow. A super heater and economizer are contained in the heat recovery area 8.

An air box 10 is arranged in a bottom of the seal box 4 so as to intake upward fluidizing air B through an air distribution plate 9. The particles in the seal box 4 are introduced to the optional external heat exchanger 6 and the in-bed tube 5 under fluidizing condition.

In a conventional CFB boiler, there may be good mixing or kinetic energy in the dense bed. However, the present inventions are based on the discovery that there may be insufficient mixing above the dense bed to more fully utilize the reactants added to reduce the emissions in the flue gases. As used herein, the top of the dense bed is generally where the gas and particle density is about twice the boiler exit gas/particle density. Generally, the dense bed has a particle density greater than about twice the boiler exit gas/particle density.

In the lower furnace, which is typically just in front of the coal feed port, volatile matter (gas phase) from the coal quickly mixes and reacts with available oxygen. This creates a low density, hot gaseous plume that is very buoyant relative to the surrounding particle laden flow. This buoyant plume quickly rises, forming a channel, chimney or plume from the lower furnace to the roof. Limestone, which absorbs and reduces the $SO_2$, is absent in the channel. After hitting the roof of the furnace, it has been discovered that this high $SO_2$ flue gas may exit the furnace and escape the cyclone without sufficient $SO_2$ reaction. Measurements of the furnace exit duct have shown nearly 10 times higher $SO_2$ concentrations in the upper portion of the exit duct relative to the bottom of the duct.

In the furnace of a conventional circulating fluidized bed boiler, bed materials 11 which comprise ash, sand, and/or limestone etc. are under suspension by the fluidizing condition. Most of the particles entrained with flue gas escape the furnace 2 and are caught by the cyclone dust collector 3 and are introduced to the seal box 4. The particles introduced to the seal box 4 are aerated by the fluidizing air B and are heat exchanged with the in-bed tubes 5 of the optional external heat exchanger 6 so as to be cooled. The particles are returned to the bottom of the furnace 2 through a duct 12 and recirculate through the furnace 2.

In the present invention, high velocity mixing air injection is utilized above the dense bed to both reduce limestone usage and reduce the NOx emissions in a circulating fluidized bed boiler. Additionally, Hg and Acid gas emissions can be reduced. The high velocity mixing air injection above the dense bed provides a vigorous mixing of the fluidized bed space, resulting in greater combustion and reaction efficiencies, thereby reducing the amount of limestone or other basic reagent needed to neutralize the flue acids to acceptable levels.

Figure 2:
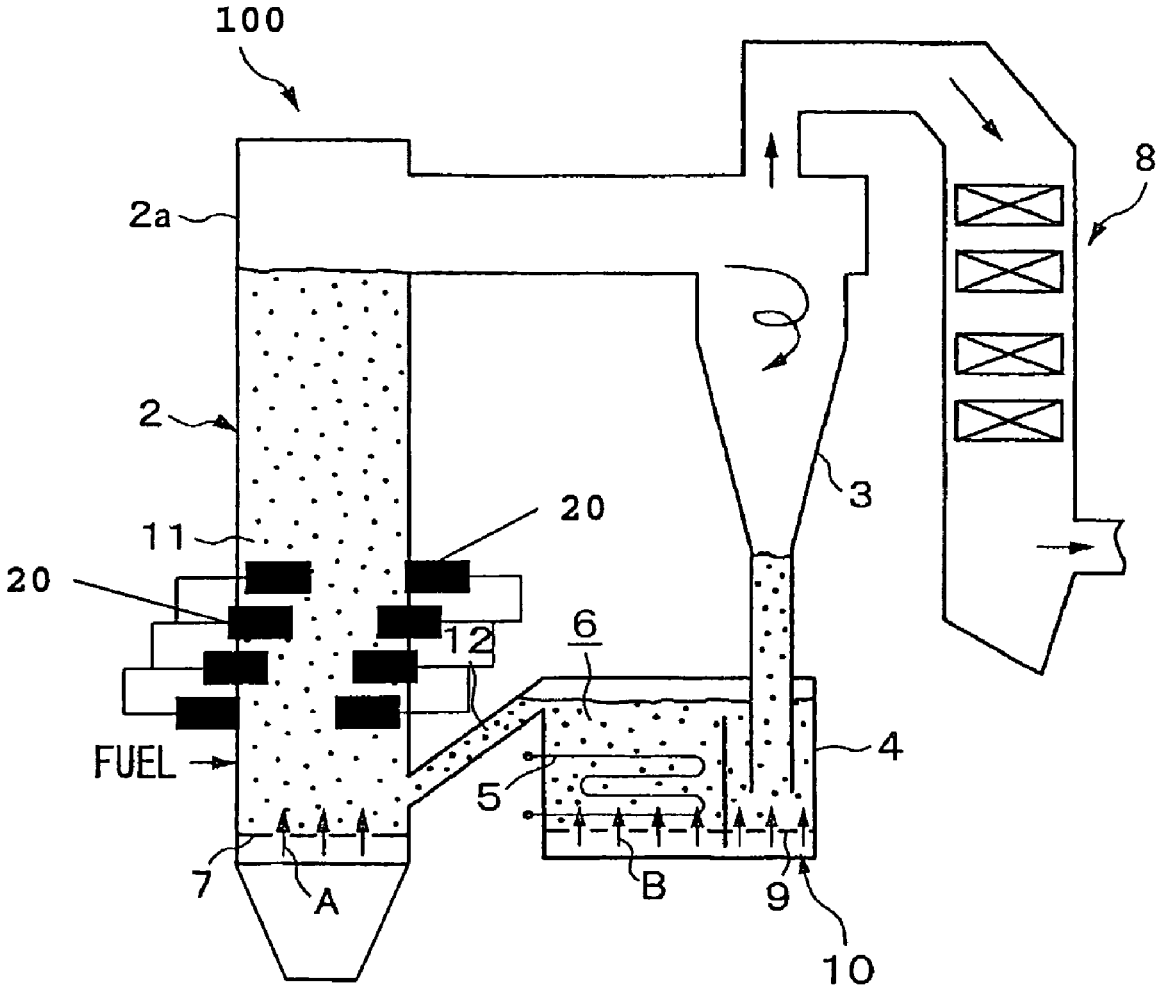
FIG. 2 is an illustration of a circulating fluidized bed boiler having improved reactant utilization constructed according to the present inventions.
Figure 3:
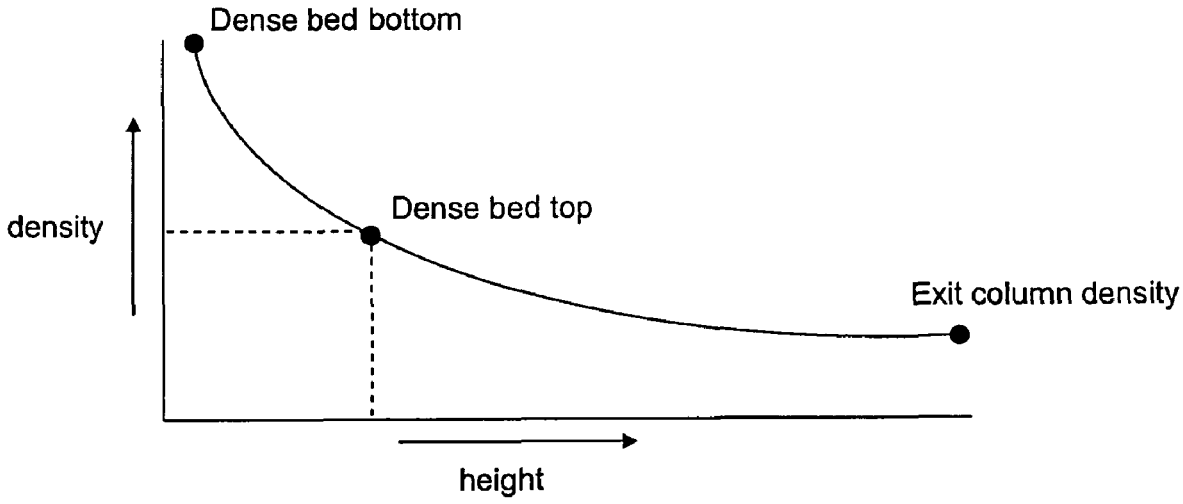
FIG. 3 is a graphical representation of the relationship of gas and particle density versus furnace height in the CFB.

In an embodiment of the present invention, generally described as 100 in FIG. 2, the circulating fluidized bed boiler of the present invention includes a series of secondary air injection ports or devices 20 advecting the secondary air into the fluidized bed above the dense bed portion. Typically, the devices are positioned in a spaced-apart manner to create rotational flow of the fluidized bed zone. The secondary air injection devices may be spaced asymmetrically to generate rotation in the boiler. Since many boilers are wider than they are deep, in an embodiment, a user may set up two sets of nozzles to promote counter rotating.

In one embodiment of the present invention, the secondary air injection devices are positioned between about 10 feet and 30 feet above the dense bed. The air injection devices are preferably arranged to act at mutually separate levels or stages on the mutually opposing walls of the reactor. This system thus provides a vigorous mixing of the fluidized bed space, resulting in greater reaction efficiency between the $SO_2$ and limestone and thereby permitting the use of less limestone to achieve a given $SO_2$ reduction level. The enhanced mixing permits the reduction of the stoichiometric ratio of Ca/S to achieve the same level of $SO_2$ reduction.

In most embodiments, the primary elements of high velocity mixing air injection above the dense bed design include:

(1) the location of the high velocity mixing air injection ports or devices being well above the dense bed portion of the CFB, where the dense bed is defined as the portion having a density greater than about twice the furnace exit (cyclone entrance) density;

(2) the high velocity mixing air injection ports or devices being designed to give rotation of the flue gas, thus further increasing downstream mixing; and (3) the high velocity mixing air ports or devices including high pressure air injection nozzles that introduce high velocity, high momentum, and high kinetic energy turbulent jet flow.

Similarly, the vigorous mixing produced by the present invention may also prevents channels or plumes and consequential lower residence time of sulfur compounds, thereby allowing them more time to react in the reactor and further increasing the reaction efficiency. The vigorous mixing also provides for more homogeneous combustion of fuel, thereby reducing "hot spots" in the boiler that can create NOx.

Typically, the mass flow of air through the high velocity mixing air injection ports above the dense bed should introduce between about 15% and 40% of the total air flow. In many embodiments, the high velocity mixing air injection ports should introduce between about 20% and 30% of the total air flow.

Typically, the exit velocities for the nozzles should be in excess of about 50 m/s. More typically, the exit velocities should be in excess of about 100 m/s.

The air flow can be hot (drawn downstream of the air heater (air-side)), ambient (drawn upstream of the air heater (air side) at the FD fan outlet), or ambient (drawn from the ambient surrounding). Air that bypasses the air heater is much less expensive to install non-insulated duct work for, but the overall efficiency of the boiler suffers.

Conventional high-velocity over-fired air applications are limited to mixing combustion zones composed primarily of flue gases and therefore do not increase the efficiency of limestone usage. In the present invention, mixing is directed to the furnace combustion zone containing a large mass of inert particles, namely the coal ash and limestone particles. Further, related technologies utilize staging for NOx reduction or high velocity jet mixing for chemical addition. In the present invention, staging may be used in addition to mixing and is used to increase the reaction time, control bed temperature control, and reduce the effects of "chimneys" in the furnace.

The present inventions may be further understood after a review of the following examples:

Example 1

FLUENT, a computational fluid dynamics analytic software program available from Fluent, Inc. of Lebanon, N.H., was used to model two-phase thermo-fluid phenomena in a CFB power plant. FLUENT solves for the velocity, temperature, and species concentrations fields for gas and particles in the furnace. Since the volume fraction of particle phase in a CFB is typically between about 0.1% and 0.3%, a granular model solving multiphase flow was applied to this case. In contrast to conventional pulverized-fuel combustion models, where the particle phase is solved by a discrete phase model in a granular model both gas phase and particle phase conservation equations are solved in an Eulerian reference frame.

The solved conservation equations included continuity, momentum, turbulence, and enthalpy for each phase. In this multi-phase model, the gas phase (>99.7% of the volume) is the primary phase, while the particle phases with its individual size and/or particle type are modeled as secondary phases. A volume fraction conservation equation was solved between the primary and secondary phases. A granular temperature equation accounting for kinetic energy of particle phase was solved, taking into account the kinetic energy loss due to strong particle interactions in a CFB. The present model took five days to converge to a steady solution, running on six CPUs in parallel.

While ash and limestone were treated in the particle phase, coal combustion was modeled in the gas phase. Coal was modeled as a gaseous volatile matter with an equivalent stoichiometric ratio and heat of combustion. The following two chemical reactions are considered in the CFB combustion system:

$$CH_{0.85}O_{0.14}N_{0.07}S_{0.02}+1.06O_2 \rightarrow 0.2CO+0.8CO_2+0.43H_2O+0.035N_2+0.02SO_2$$
$$CO+0.5O_2 \rightarrow CO_2$$

The chemical-kinetic combustion model included several gas species, including the major products of combustion: CO, $CO_2$, and $H_2O$. The species conservation equations for each gas species were solved. These conservation laws have been described and formulated extensively in computational fluid dynamics (CFD) textbooks. A k-ϵ turbulence model was implemented in the simulation, and incompressible flow was assumed for both baseline and invention cases.

All differential equations were solved in unsteady-state because of the unsteady-state hydrodynamic characteristics in the CFB boiler. Each equation was solved to the convergence criterion before the next time step is begun. After the solution was run through several hundred-time steps, and the solution was behaving in a "quasi" steady state manner, the time step was increased to speed up convergence. Usually the model was solved for more than thirty seconds of real time to achieve realistic results.

The CFD computational domain used for modeling is 100 feet high, 22 feet deep, and 44 feet wide. The furnace has primary air inlet through grid and 14 primary ports on all four walls. It also has 18 secondary ports, 8 of them with limestone injection, and 4 start-up burners on both front and back walls. Two coal feeders on the front wall convey the waste coal into the furnace. The other two coal feeders connect to each of the cyclone ducts after the loop seal. Two cyclones connecting to the furnace through two ducts at the top of the furnace collect the solid materials, mainly coal ash and limestone, and recycle back into the furnace at the bottom. The flue gas containing major combustion products and fly ash and fine reacted (and/or unreacted) limestone particles leaves the top of the cyclone and continue in the backpass. Water walls run from the top to the bottom of all four-side walls of the furnace. There were three stages of superheaters. The superheater I and II are in the furnace, whereas the superheater III is in the backpass.

The cyclone was not included in the CFB computational domain because the hydrodynamics of particle phase in the cyclone is too complex to practically include in the computation. The superheat pendants are included in the model to account for heat absorption and flow stratification, and are accurately depicted by the actual number of pendants in the furnace with the actual distance. Note that the furnace geometry was symmetric in width, so the computational domain only represents one half of the furnace. Consequently, the number of computational grid is only half, which reduced computational time.

Table 1 shows the baseline system operating conditions including key inputs for the model furnace CFD baseline simulations.

TABLE 1

| Parameter | Unit | Value |
|---|---|---|
| System load | $MW_{gross}$ | 122 |
| Net load | $MW_{net}$ | 109 |
| System firing rate | MMBtu/hr | 1226 |
| System excess $O_2$ | %-wet | 2.6 |
| System excess Air | % | 14.9 |
| System coal flow | kpph | 187 |
| Total air flow (TAF) | kpph | 1114 |
| Primary air flow rate through bed grid | kpph | 476 |
| Primary air flow rate through 14 ports | kpph | 182 |
| Primary air temperature | ° F. | 434 |
| Secondary air flow rate through 18 injection ports | kpph | 262 |
| Secondary air through 4 start-up burners | kpph | 104 |
| Secondary air through 4 coal feeders | kpph | 65 |
| Air flow rate through limestone injection | kpph | 11.5 |
| Air flow through loop seal | kpph | 12.8 |
| Secondary air temperature | ° F. | 401 |
| Limestone injection rate | kpph | 40 |
| Solid recirculation rate | kpph | 8800 |

Table 2 shows the coal composition of the baseline case.

TABLE 2

| Sample Time | | |
|---|---|---|
| Proximate analysis | | |
| Volatiles Matter | [wt % ar] | 15.09 |
| Fixed Carbon | [wt % ar] | 35.06 |
| Ash | [wt % ar] | 42.50 |
| Moisture | [wt % ar] | 7.07 |
| HHV (Btu/lb) | [Btu/lb] | 6800.0 |
| Ultimate analysis | | |
| C | [wt % ar] | 41.0 |
| H | [wt % ar] | 2.1 |
| O | [wt % ar] | 1.2 |
| N | [wt % ar] | 3.5 |
| S | [wt % ar] | 2.63 |
| Ash | [wt % ar] | 42.5 |
| $H_2O$ | [wt % ar] | 7.07 |

In FLUENT, the coal is modeled as a gaseous fuel stream and a solid particle ash stream with the flow rates calculated from the total coal flow rate and coal analysis. The gaseous fuel is modeled as $CH_{0.85}O_{0.14}N_{0.07}S_{0.02}$ and is given a heat of combustion of $-3.47\times10^7$ J/kmol. This is equivalent to the elemental composition and the heating value of the coal in the tables.

In the following section, the baseline case results are compared to the invention case results.

High velocity injection significantly improves the mixing by relatively uniformly distributing air into the furnace. The mixing of the furnace can be quantified by a coefficient of variance (CoV), which is defined as standard deviation of $O_2$ mole fraction averaged over a cross section divided by the mean $O_2$ mole fraction. The Coefficient of Variance ($\sigma/\bar{x}$) in $O_2$ distribution for the baseline case and invention case over four horizontal planes are compared in Table 3. As can be seen, all four planes have high CoV in the baseline case with a range from 66% to 100%, but are significantly lower in both invention cases, indicating that the mixing is significantly improved.

TABLE 3

| Furnace Height [ft] | Baseline case | Invention case |
|---|---|---|
| 33 | 66% | 43% |
| 49 | 84% | 40% |
| 66 | 100% | 47% |
| 80 | 80% | 46% |

Figure 4:
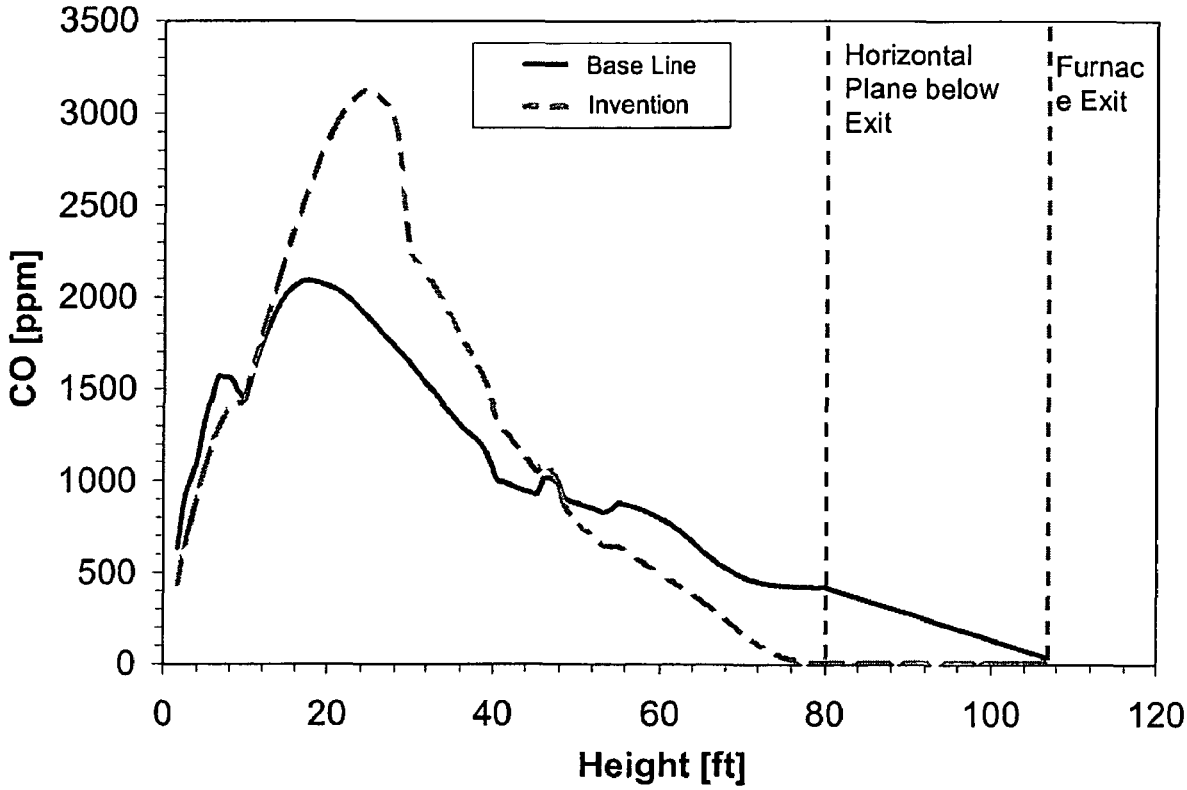
FIG. 4 is a graphical representation of the relationship of mass weighted CO versus height for the baseline case and the present invention case.

As best seen in FIG. 4, the mass weighted CO versus height for the baseline case and invention case is compared. Due to staging in the invention case, the CO concentration is higher than that in the baseline case in the low bed below the high velocity air injection ports. Above the high velocity air ports, the CO concentration rapidly decreases, and the furnace exit CO is even lower than that in the baseline case. The rapid reduction in CO indicates better and more complete mixing.

Figure 5:
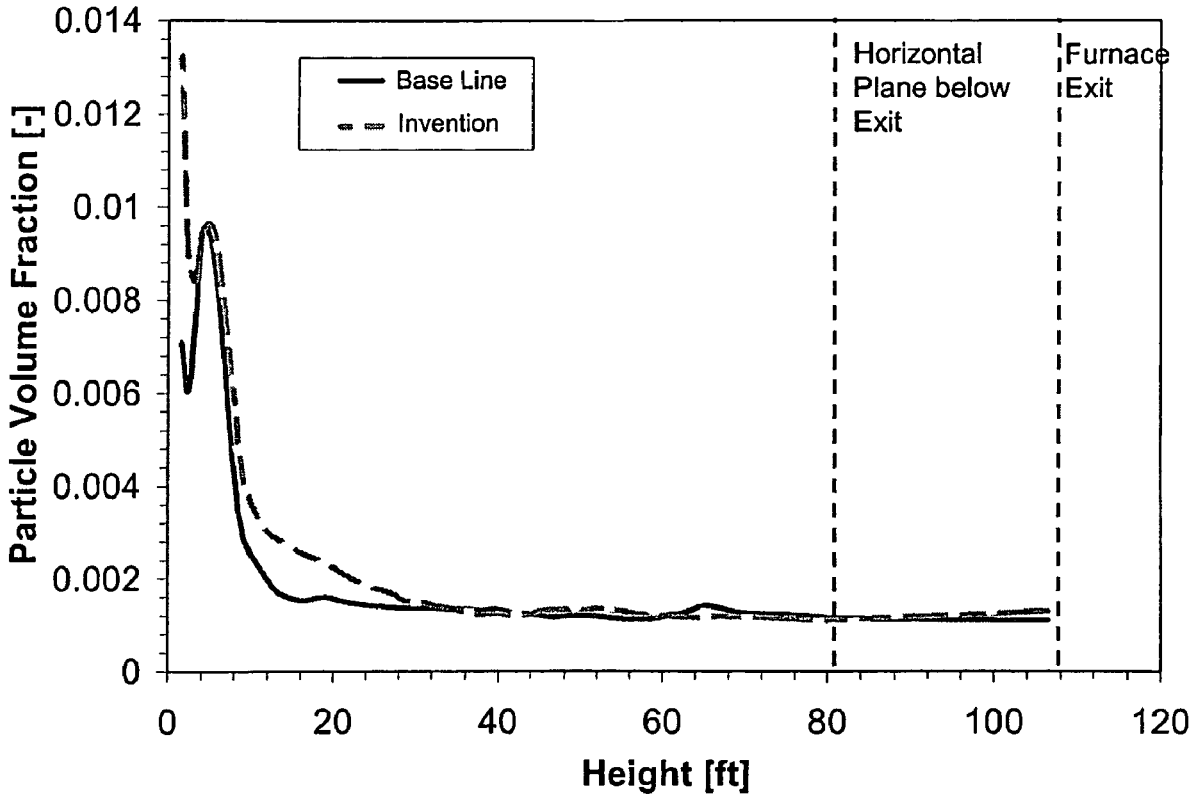
FIG. 5 is a graphical representation of the relationship of the mass-averaged particle volume fraction versus height for the baseline case and the present invention case.

The particle fraction distributions of the baseline case and the present invention case are shown in FIG. 5. The figure clearly shows the lower bed is more dense than the dilute upper bed. The solid volume fraction in the upper furnace is between 0.001 to 0.003. The distribution also reveals particle clusters in the bed, which is one of the typical features of particle movement in CFBs. The air and flue gas mixtures move upward through these clusters. Similar particle flow characteristics can be seen in the present invention case, however, it is also observed that the lower bed below the high velocity air injection is slightly denser than the baseline case, due to low total air flow in the lower bed. The upper bed in the present invention case shows similar particle volume fraction distribution to the baseline case.

Figure 6:
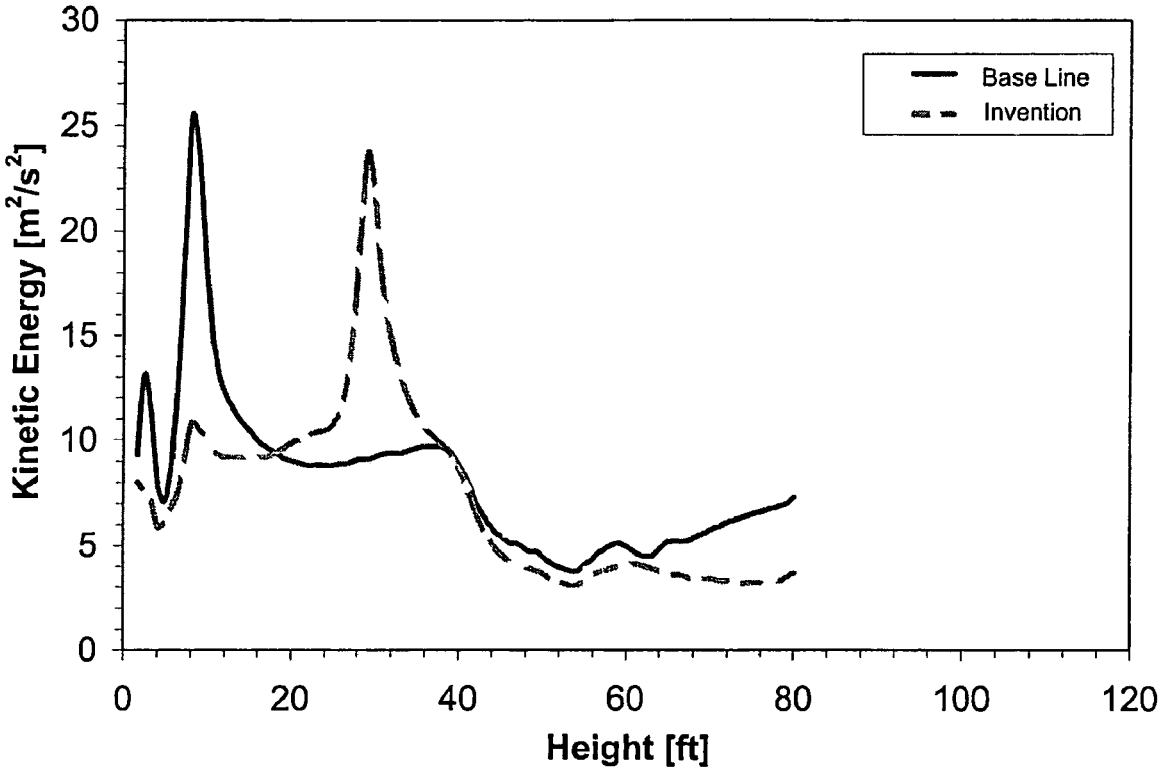
FIG. 6 is a graphical representation of the relationship of the mass weighted turbulent kinetic energy versus height for the baseline case and the present invention case.

The turbulent mixing of air jets and bed particles for both the baseline case and invention case are compared in FIG. 6. In the baseline case, a maximum turbulent kinetic energy appears in the dense bed in the lower furnace caused by the secondary air injection. However, this highest turbulent rapidly diminishes as these jets penetrate into and mix in the furnace. In the invention case, the peak kinetic energy is located well above the dense bed, which allows for significant penetration and mixing.

Turbulence is dissipated into the bulk flow through eddy dissipation. That is, large amount of kinetic energy results in better mixing between the high velocity air and the flue gas. While in the baseline case, the high turbulence in the bottom bed is important for dense particle mixing, the upper furnace high turbulence as shown in the invention case significant improves the mixing between solid particles and flue gas. Which is possibly one of the reasons for the reduced CO, more evenly distributed $O_2$, and enhanced heat transfer observed in the invention case.

The mechanisms for reduction of $SO_2$ and other chemical species by limestone reaction through mixing have been discussed above. However, the calculated results achieved were better than would be expected. The use of deep staging in the primary stage reduces the magnitude of the gas channels formed in the primary stage in and of itself. The addition of high-velocity air nozzles above the dense bed destroys any channels that are formed and causes the collapse of the channel below it. Therefore, the combination of staging and asymmetric opposed high-velocity air nozzles above the dense bed produced surprising results.

The enhanced mixing achieved using the present invention is predicted to reduce the stoichiometric ratio of Ca/S in the CFB from ~3.0 to ~2.4, while achieving the same level of $SO_2$ reduction (92%). The reduction in Ca/S corresponds to reduced limestone required to operate the boiler and meet $SO_2$ regulations. Since limestone for CFB units often costs more than the fuel (coal or gob), this is a significant reduction on the operational budget for a CFB plant.

Certain modifications and improvements will occur to those skilled in the art upon a reading of the foregoing description. By way of example, secondary air injection ports could be installed inline and only some of the secondary air injection ports may operate at any given time. Alternatively, all of the secondary air injection ports may be run, with only some of the air injection ports running at full capacity. It should be understood that all such modifications and improvements are properly within the scope of the following claims.

What is claimed is:

1. A method of operating a furnace having a circulating fluidized bed, said method comprising the steps of:

combusting fuel in said fluidized bed, wherein said fluidized bed includes a dense bed portion and a lower furnace portion above said dense bed portion;

injecting a reactant into said furnace to reduce the emission of at least one combustion product in the flue gas; and injecting secondary air into said furnace above said dense bed at a height in the furnace where gas and particle density is less than about 165% of the furnace exit gas and particle density;

thereby reducing the amount of reactant needed to reduce the emission of said at least one combustion product.

2. The method of claim 1, wherein said dense bed portion has a density greater than about twice the furnace exit density.

3. The method of claim 1, wherein said secondary air is injected through a plurality of secondary air injection devices.

4. The method of claim 3, wherein said plurality of secondary air injection devices are positioned to create rotation in the furnace.

5. The method of claim 3, wherein said plurality of secondary air injection devices are asymmetrically positioned with respect to one another.

6. The method of claim 3, wherein said plurality of secondary air injection devices are positioned between about 10 feet and 30 feet above said dense bed portion.

7. The method of claim 3, wherein the ratio of said exit column density to the density of the dense bed top is greater than about 0.6, and wherein said plurality of secondary air injection devices are positioned above said dense bed top.

8. The method of claim 3, wherein at least one of said plurality of secondary air injection devices are operated to have a jet penetration, when unopposed, of greater than about 50% of the furnace width.

9. The method of claim 8, wherein said jet stagnation pressure is greater than about 15 inches of water above the furnace pressure.

10. The method of claim 8, wherein said jet stagnation pressure is about 15 inches to about 40 inches of water above the furnace pressure.

11. The method of claim 3, wherein said secondary air injection devices deliver between about 10% and 35% of the total air flow to the boiler.

12. The method of claim 1, wherein said secondary air is injected into the lower furnace portion of the circulating fluidized bed boiler.

13. The method of claim 1, wherein said dense bed portion is operated as a fuel rich stage maintained below the stoichiometric ratio.

14. The method of claim 1, wherein said lower furnace portion is operated as a fuel lean stage maintained above the stoichiometric ratio.

15. The method of claim 1, wherein said reactant is selected from the group consisting of caustic, lime, limestone, fly ash, magnesium oxide, soda ash, sodium bicarbonate, sodium carbonate, double alkali, sodium alkali, and the calcite mineral group which includes calcite ($CaCO_3$), gaspeite ({Ni, Mg, Fe}$CO_3$), magnesite ($MgCO_3$), otavite ($CdCO_3$), rhodochrosite ($MnCO_3$), siderite ($FeCO_3$), smithsonite ($ZnCO_3$), sphaerocobaltite ($CoCO_3$), and mixtures thereof.

16. The method of claim 1, wherein said reactant is limestone.

17. The method of claim 1, further including returning carry over particles from the flue gas to the circulating fluidized bed.

18. The method of claim 17, wherein returning carry over particles includes passing said particles through a separator.

19. The method of claim 18, wherein said separator is a cyclone separator.

20. The method of claim 18, further including positioning a fines collector downstream from the separator.

21. A method of operating a boiler having a furnace containing a circulating fluidized bed, said method comprising the steps of:

combusting fuel in said fluidized bed having a dense bed portion and a lower furnace portion adjacent to said dense bed portion;

maintaining the density of said dense bed portion at greater than about twice the furnace exit density;

injecting a reactant into said furnace to reduce the emission of at least one combustion product in the flue gas; and injecting secondary air above said dense bed through a plurality of secondary air injection devices at a height in the furnace where gas and particle density is less than about 165% of the furnace exit gas and particle density;

thereby reducing the amount of reactant needed to reduce the emission of said at least one combustion product.

22. The method of claim 21, including maintaining said dense bed portion below the stoichiometric ratio.

23. The method of claim 21, including maintaining said lower furnace portion above the stoichiometric ratio.

24. The method of claim 21, wherein said plurality of secondary air injection devices are positioned to create rotation in the furnace.

25. The method of claim 21, wherein said plurality of secondary air injection devices are asymmetrically positioned with respect to one another.

26. The method of claim 21, wherein said plurality of secondary air injection devices are positioned between about 10 feet and 30 feet above said dense bed portion.

27. The method of claim 21, wherein the ratio of said exit column density to the density of the dense bed top is greater than about 0.6, and wherein said plurality of secondary air injection devices are positioned above said dense bed top.

28. The method of claim 21, wherein at least one of said plurality of secondary air injection devices are operated to have a jet penetration, when unopposed, of greater than about 50% of the furnace width.

29. The method of claim 21, wherein said jet stagnation pressure is greater than about 15 inches of water above the furnace pressure.

30. The method of claim 21, wherein said jet stagnation pressure is about 15 inches to about 40 inches of water above the furnace pressure.

31. The method of claim 21, wherein said secondary air injection devices deliver between about 10% and 35% of the total air flow to the boiler.

32. The method of claim 21, wherein said secondary air is injected into the lower furnace portion of the circulating fluidized bed boiler.

33. The method of claim 21, wherein said reactant is selected from the group consisting of caustic, lime, limestone, fly ash, magnesium oxide, soda ash, sodium bicarbonate, sodium carbonate, double alkali, sodium alkali, and the calcite mineral group which includes calcite ($CaCO_3$), gaspeite ({Ni, Mg, Fe}$CO_3$), magnesite ($MgCO_3$), otavite ($CdCO_3$), rhodochrosite ($MnCO_3$), siderite ($FeCO_3$), smithsonite ($ZnCO_3$), sphaerocobaltite ($CoCO_3$), and mixtures thereof.

34. The method of claim 21, wherein said reactant is limestone.

35. The method of claim 21, further including returning carry over particles from the flue gas to the circulating fluidized bed.

36. A circulating fluidized bed boiler having improved reactant utilization, the circulating fluidized bed boiler comprising:

a circulating fluidized bed including a dense bed portion and a lower furnace portion above the dense bed portion;

a reactant to reduce the emission of at least one combustion product in the flue gas; and a plurality of secondary air injection devices positioned downstream of the dense bed for providing mixing of the reactant and the flue gas in the furnace above the dense bed, wherein the secondary air injection devices are positioned at a height in the furnace where the gas and particle density is less than about 165% of the furnace exit gas and particle density, and the amount of reactant required for the reduction of the emission of the combustion product is reduced.

* * * * *